United States Patent [19]

Iwama

[11] Patent Number: 4,649,657

[45] Date of Patent: Mar. 17, 1987

[54] SKI BOOT

[75] Inventor: Shinichi Iwama, Tokyo, Japan

[73] Assignee: Daiwa Seiko Inc., Tokyo, Japan

[21] Appl. No.: 812,923

[22] Filed: Dec. 23, 1985

[30] Foreign Application Priority Data

Dec. 24, 1984 [JP] Japan ..... 59-195746[U]
Dec. 24, 1984 [JP] Japan ..... 59-195747[U]
Dec. 24, 1984 [JP] Japan ..... 59-195748[U]

[51] Int. Cl.[4] ..... A43B 5/04; A43B 11/00; A43C 11/00

[52] U.S. Cl. ..... 36/117; 36/50; 24/68 SK

[58] Field of Search ..... 36/117–121, 36/50; 24/68 SK, 69 SK, 70 SK, 71 SK

[56] References Cited

U.S. PATENT DOCUMENTS 3,668,791 6/1972 Salzman et al. ..... 36/50
4,104,811 8/1978 Salomon ..... 36/121
4,258,482 3/1981 Salomon ..... 36/121
4,563,825 1/1986 Tesser ..... 36/131
4,565,017 1/1986 Ottieri ..... 36/117

FOREIGN PATENT DOCUMENTS 2006001 10/1978 Fed. Rep. of Germany ..... 36/121
3431746 3/1985 Fed. Rep. of Germany ..... 36/117

*Primary Examiner*—James Kee Chi
*Attorney, Agent, or Firm*—Kalish & Gilster

[57] ABSTRACT

A ski boot having a lower shell and upper outer and inner shells being spaced apart to define front and rear openings within which are tiltably mounted front and rear cuffs. A band is wound around the outer peripheries of said shells and cuffs; there being a device for tightening said band. There is a forward inclination angle adjusting mechanism for adjusting the angle of forward inclination of the skier's leg including means for adjusting the length of the portion of the band extending across the front cuff and being arranged for moving circumferentially. Said boot may also include a forward inclination pressure adjusting mechanism to adjust the pressure applied to the skier's leg by the boot when the skier moves forwardly. The boot of the present invention may contain either the forward inclination angle adjusting mechanism or the forward inclination pressure adjusting mechanism or both.

10 Claims, 29 Drawing Figures

SKI BOOT

BACKGROUND OF THE INVENTION

The present invention relates to a ski boot and, more particularly, to an improvement in a ski boot which enables adjustment of the angle of forward inclination of the leg and/or the pressure applied to the leg of the skier from the boot upper when he leans forward by using a band and a fastening member for fastening the upper shell portion corresponding to the ankle.

A typical ski boot in recent years is composed of a shell molded of a rigid plastic material, and an inner boot portion for closely and tightly maintaining the leg within the shell. In order to allow the foot to be stably and yet comfortably retained within the ski boot and thereby to enable the skier to effectively control the ski during skiing, a fastening mechanism is employed to fasten the upper shell portion corresponding to the ankle, or to hold the instep of the foot, thereby allowing the ankle to be reliably and yet flexibly fitted in the boot.

It is a known prior art to provide the fastening mechanism for fastening the upper shell portion with the function which enables adjustment of the angle of forward inclination of the boot in order to maintain the skier in a forwardly leaning position which is ideal for preventing the leg muscles from becoming exhausted, and the function which enables adjustment of the stiffness of the upper shell portion which determines the magnitude of pressure applied to the leg when the skier assumes a forwardly leaning position (the stiffness will be referred to as the "forward inclination pressure", hereinafter). This prior art is disclosed in, for example, the specification of U.S. Pat. No. 4,104,811.

The conventional ski boot fastening mechanism described above is arranged such that a plurality of retaining bores are circumferentially provided in a ski boot on each of the right and left sides of the upper flap thereof, and each of the two portions of a fastening collar is positioned at one of the retaining bores on each side of the upper flap and is secured thereat by a fastening member, and then, the free end portion of the collar which is engaged with a rear support member provided at the upper of the ski boot is tightened by a buckle connected to the fixed end of the color corresponding to the free end portion, thereby applying a predetermined stiffness (forward inclination pressure) to the upper of the ski boot and varying the angle of forward inclination of the boot upper with respect to the plane of the sole.

However, the above-described conventional fastening mechanism suffers from the following problems. Namely, when the collar is positioned and secured to the upper of the ski boot, since the the fastening members which are separate from both the boot upper and the collar are employed, it is complicated to change the retained position of the collar with respect to the retaining bores. In particular, when the angle of forward inclination and the forward inclination pressure are to be adjusted immediately before sliding, the operation of changing the collar retaining position is extremely troublesome and takes a relatively long time. In addition, it may be necessary for a skier who is inexperienced in changing the collar retaining position to remove his foot from the ski boot in order to effect this operation. Further, the conventional fastening mechanism makes it impossible to effect fine adjustment of the forward inclination pressure of the boot upper and the fine adjustment of the angle of forward inclination of the boot upper with respect to the plane of the sole, and it is not possible to adjust the forward inclination pressure and the angle of forward inclination so that they are matched with the leg of each individual skier, unless the collar is replaced. Furthermore, since the fastening membere are separated from the ski boot when it is not used, there is a risk of the fastening members being lost, and it is troublesome to handle and manage the fastening member.

SUMMARY OF THE INVENTION

In view of the above problems of the prior art, it is an object of the present invention to provide a ski boot which enables setting of the circumferential and/or vertical position of the fastening band with respect to the boot upper shell in a single and simple operation at the time of adjustment of the forward inclination angle and/or the forward inclination pressure, whereby the adjustment operation is facilitated so that even an inexperienced skier can use the ski boot without anxiety.

It is another object of the present invention to provide a ski boot which enables fine adjustment of the angle of forward inclination of the leg of the skier and the forward inclination pressure applied to his leg from the boot upper and permits setting of an optimum forward inclination angle and forward inclination pressure suitable for the leg of each individual skier by means of the same band as that for fastening the ski boot and which further allows even an inexperienced skier to use the same without anxiety.

It is still another object of the present invention to provide a ski boot which enables fine adjustment of the angle of forward inclination of the leg of the skier and permits setting of an optimum forward inclination angle suitable for the leg of each individual skier by means of the same band as that for fastening the ski boot and which further allows even an inexperienced skier to use the same without anxiety.

It is a further object of the present invention to provide a ski boot which enables fine adjustment of the forward inclination pressure applied to the leg of a skier from the boot upper and permits setting of an optimum forward inclination pressure suitable for the leg of each individual skier by means of the same band as that for fastening the ski boot and which further allows even an inexperienced skier to use the same without anxiety.

It is a still further object of the present invention to provide a ski boot which enables setting of the circumferential position of the fastening band with respect to the boot upper shell in a single and simple operation at the time of adjustment of the forward inclination angle, whereby the adjustment operation is facilitated so that even an inexperienced skier can use the ski boot without anxiety.

It is a still further object of the present invention to provide a ski boot which enables setting of the vertical position of the fastening band with respect to the boot upper shell in a single and simple operation at the time of adjustment of the forward inclination pressure, whereby the adjustment operation is facilitated so that even an inexperienced skier can use the ski boot without anxiety.

One feature of the present invention resides in the arrangement in which it is possible by using the same band to effect fastening of the ski boot and adjustment of either or both the forward inclination angle and the forward inclination pressure. By virtue of this arrangement, the structure of the ski boot as a whole becomes exceedingly simple and compact, and the weight of the ski boot is consequently reduced. The foot of a skier is comfortably fitted into the ski boot as one unit, thereby allowing the skier to perform better skiing. Further, even when the skier continuously wears the ski boot for a long period of time, there is no risk of his leg becoming exhausted.

Another feature of the present invention resides in that it is possible for even an inexperienced skier to easily effect the adjustment operation without requiring much labor, since the fastening of the ski boot and the adjustment operation can be simultaneously effected by means of the same band.

Still another feature of the present invention resides in that fine adjustment for the leg of each individual skier can be effected easily in a single and simple operation in accordance with circumstances without any need for the skier to remove his foot from the ski boot.

DESCRIPTION OF THE PREFERRED EMBODIMENTS

Figure 1:
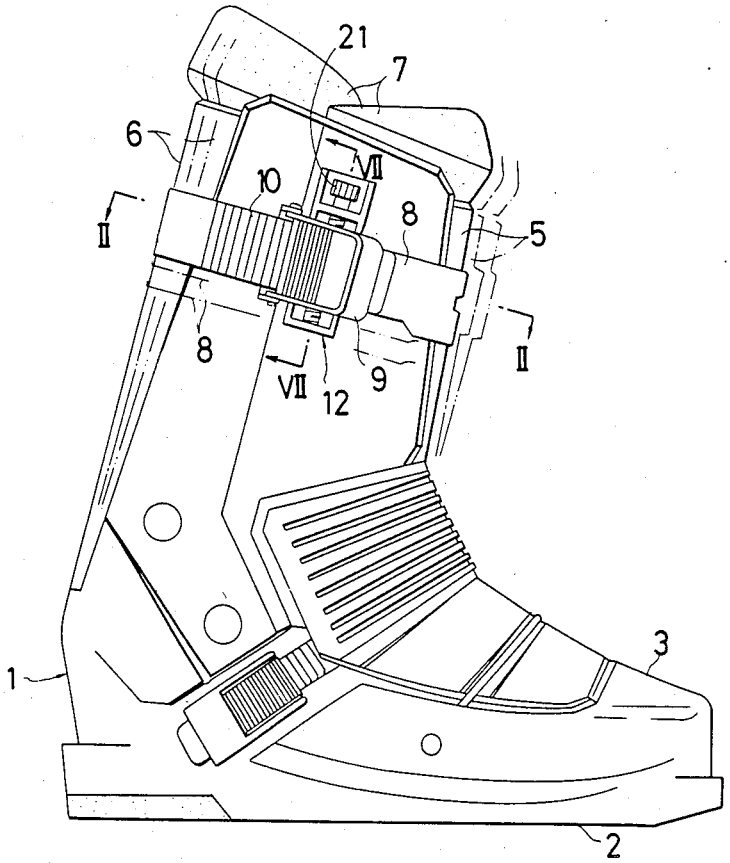
FIG. 1 is a side view of a ski boot equipped with forward inclination angle and forward inclination pressure adjusting mechanisms in accordance with a first embodiment of the present invention.
Figure 2:
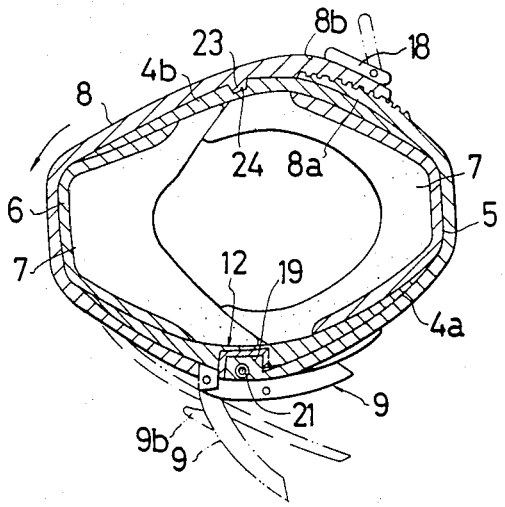
FIG. 2 is a sectional view taken along the line II—II of FIG. 1.

Preferred embodiments of the present invention will be described below with reference to the accompanying drawings.

FIGS. 1 to 7 show in combination a first embodiment of the ski boot according to the present invention which is provided with a fastening mechanism having functions of adjusting the angle of forward inclination of the leg and the forward inclination pressure. In these Figures, the reference numeral 1 denotes a shell body molded from a rigid plastic material such as a polyurethane. The shell body 1 is constituted by a sole 2, a lower shell 3 covering the foot, and outer and inner upper shells 4*a*, 4*b* which respectively cover the right- and left-hand sides of the ankle. The upper shells 4*a*, 4*b* are so shaped that they cover the right- and left-hand sides of the ankle, respectively. In consequence, the front and rear of the shell body 1 are opened, and the shells 4*a*, 4*b* are tilted forwards. In addition, the openings at the front and rear of the shell body 1 are respectively closed by a front cuff 5 and a rear cuff 6 from the inner sides of the upper shells 4*a*, 4*b*. The respective lower ends of the front and rear cuffs 5 and 6 are pivotally connected to the lower shell 3 so that the cuffs 5 and 6 can tilt forwards and backwards. Thus, when the foot is inserted into the ski boot, both the cuffs 5, 6 are tilted so as to be expanded outwards as shown by the two-dot chain line in FIG. 4.

The reference numeral 7 denotes inner boots molded from a flexible material and interposed between the shell body 1 and the foot of the skier for the purpose of appropriately fitting the foot of the skier into the shell body 1. The numeral 8 denotes a band for tightening the respective upper outer peripheries of the upper shells 4*a*, 4*b* and the front and rear cuffs 5, 6, while the numeral 9 denotes a buckle for applying a tightening force to the band 8. The buckle 9 is constituted by a frame member 9*a* pivotally connected to one end of the band 8, and a pawl member 9*b* which engages with a saw-tooth portion 10 formed on the outer surface of the other end of the band 8. The band 8 further has a forward inclination angle adjusting mechanism for adjusting the angle of forward inclination of the leg (the angle of forward inclination of the upper of the ski boot with respect to the plane of the sole) by adjusting the length of a portion of the band 8 on the front cuff side which is restrained from moving circumferentially by the outer and inner upper shells 4*a*, 4*b*, and a forward inclination pressure adjusting mechanism 12 for adjusting the pressure applied to the leg of the skier from the boot upper when he leans forward by vertically adjusting the position of the upper portion of the shell body 1 at which it is tightened by the band 8.

Figure 5:
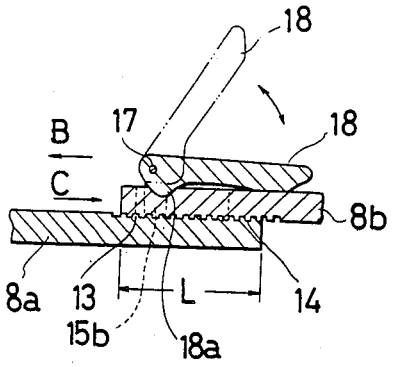
FIG. 5 is an enlarged sectional view taken along the line V—V of FIG. 4.
Figure 6:
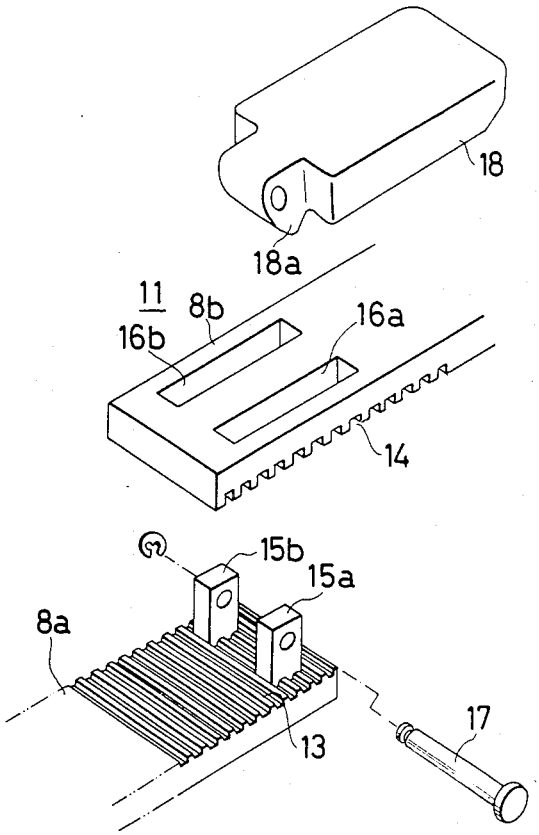
FIG. 6 is an exploded perspective view of the forward inclination angle adjusting portion according to the present invention.

The forward inclination angle adjusting mechanism 11 has separable overlap portions 8*a*, 8*b* for adjusting the length of the portion of the band 8 on the front cuff side. The overlap portions 8*a*, 8*b* are respectively formed in their joint surfaces with a multiplicity of joint spline grooves 13, 14 which engage with each other, the spline grooves 13, 14 being arranged parallel to each other in the longitudinal direction of the overlap portions 8*a*, 8*b*, as shown in FIGS. 5 and 6. A pair of connecting projections 15*a*, 15*b* are formed on the surface of the overlap portion 8*a* which opposes the spline grooves 14. A pair of slots 16*a*, 16*b* into which the connecting projections 15*a*, 15*b* are respectively fitted are longitudinally formed in the overlap portion 8*b*. The proximal end portion of a clamp lever 18 is pivotally connected to the connecting projections 15*a*, 15*b* through a pivot pin 17. The clamp lever 18 is formed on its proximal end portion with a cam 18*a* which presses the overlap portion 8*b* against the overlap portion 8*a* so that they are connected together.

Figure 3:
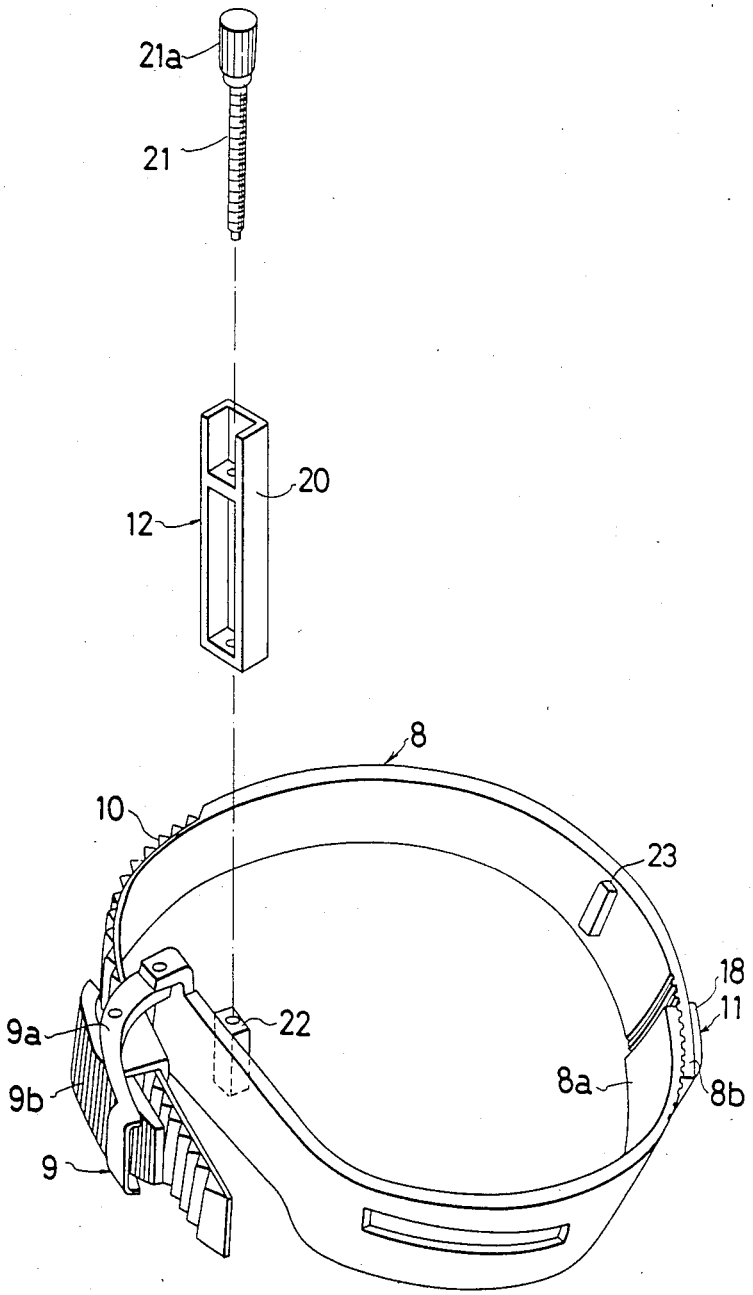
FIG. 3 is a perspective view of the whole arrangement of a band having the forward inclination angle and forward inclination pressure adjusting mechanisms according to the present invention.
Figure 7:
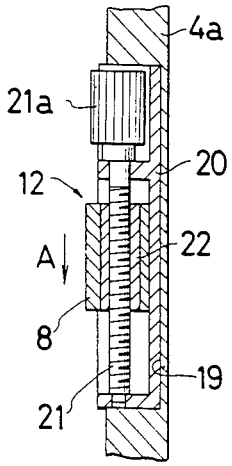
FIG. 7 is an enlarged sectional view taken along the line VII—VII of FIG. 1.

The forward inclination pressure adjusting mechanism 12 is, as shown in FIGS. 3 and 7, constituted by a frame member 20 inserted into a vertically elongated recess 19 formed in the outer surface of the outer upper shell 4*a* of the shell body 1, a screw member 21 with a crown 21*a* which is rotatably supported within the frame member 20, and a movable member 22 which is in thread engagement with the screw member 21 so that it is vertically movable within the frame member 20, the movable member 22 being integrally secured to the inner surface of a portion of the band 9 on the side thereof which is closer to the buckle 9.

A retaining portion 23 is formed on the inner surface of a portion of the band 8 on the side thereof which is closer to the overlap portion 8*b*. The retaining portion 23 is engaged with a vertically elongated recess 24 formed in the outer surface of the inner upper shell 4*b* of the shell body 1 so that the retaining portion 23 is vertically slidable but is prevented from moving circumferentially.

The following is a description of the operation of this embodiment arranged as detailed above.

Figure 4:
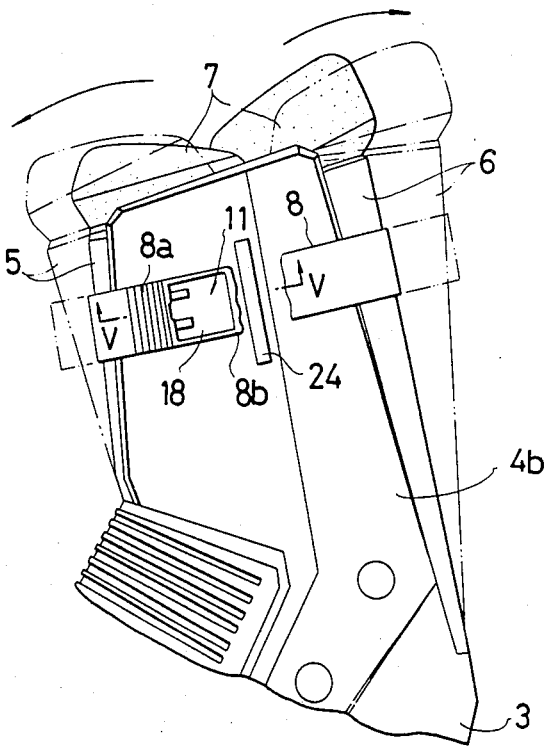
FIG. 4 is a fragmentary side view of the ski boot according to the present invention as viewed from the inside thereof.

To wear the ski boot in a state wherein the foot of the skier appropriately fits with the boot, first, the front and rear cuffs 5 and 6 are tilted as shown by the two-dot chain line in FIG. 4, and the foot is inserted into the space defined by the inner boots 7. Then, the front and rear cuffs 5 and 6 are set as shown by the solid line in FIG. 4. Thereafter, the length of the portion of the band 8 on the front cuff side is set by adjusting the length by which one of the portions 8*a*, 8*b* overlaps the other in accordance with the girth of the ankle of the skier and the desired angle of forward inclination of the leg, and the clamp lever 18 is set in the position shown by the solid line in FIG. 5 so that the overlap portions 8*a*, 8*b* are connected together. Then, the band 8 is wound around the respective outer peripheries of the upper shells 4*a*, 4*b* and the cuffs 5, 6, and the retaining portion 23 of the band 8 is engaged with the recess 24 of the upper shell 4*b*. In this state, the end of the band 8 on the side thereof which is closer to the saw-tooth portion 10 is inserted into the buckle 9, and the pawl member 9*b* is engaged with the saw-tooth portion 10. Then, the buckle frame member 9*a* is pivoted in the tightening direction. Thereupon, the tightening force of the band 8 causes the whole of the upper shells 4*a*, 4*b*, including the cuffs 5, 6, to be tightened in the contracting direction. At this time, the portion of the band 8 between the retaining portion 23 and the forward inclination pressure adjusting mechanism 12 and on the overlapping side, which opposes the front cuff 5, is restrained from moving by virtue of the retaining portion 23 and the frame member 20 which are respectively engaged with the recesses 24 and 19. Therefore, said band portion is hardly moved in the direction of the arrow shown in FIG. 2 even when the tightening force is applied to the band 8 by means of the buckle 9. However, the free end, that is, the portion of the band 8 on the side thereof which is closer to the saw-tooth portion 10 is moved in the direction of the arrow in FIG. 2 by that tightening force. In consequence, the portion of the band 8 on the rear cuff side is tightened inwardly, thus causing the whole of the inner boots 7, including the rear cuff 6, to be pushed toward the front cuff 5 with respect to the upper shells 4*a*, 4*b*. Accordingly, the leg is forcedly inclined forwards with respect to the plane of the sole 2 of the shell body 1. The forward inclination pressure at this time is set by vertically adjusting the position of the band 8 using the forward inclination pressure adjusting mechanism 12.

When the angle of forward inclination of the inner boots 7 and the front and rear cuffs 5, 6, including the leg, is desired to be made larger than that in the state shown by the solid line in FIG. 1, first, the band 8 is loosened, and the clamp lever 18 of the forward inclination angle adjusting mechanism 11 is actuated so as to change the position from that shown by the solid line to that shown by the two-dot chain line in FIG. 5, whereby the overlap portions 8*a*, 8*b* are released from the clamping force and either the overlap portion 8*a* or 8*b* is moved to in the direction of either the arrow B or C shown in FIG. 5, thereby adjusting the length by which one of the portions 8*a* and 8*b* overlaps the other. More specifically, when this overlap length is to be increased, the length of the portion of the band 8 on the front cuff side and between the retaining portion 23 and the frame member 20 (or the screw member 21) is shortened, while when the overlap length is to be decreased, that band length is elongated.

Accordingly, when the outer periphery of the upper portion of the shell body 1 is tightened by the band 8 in which the length L by which one of the portions 8*a* and 8*b* overlaps the other is made smaller than that in the case shown in FIG. 5, the forwardly leaning posture of the front and rear cuffs 5, 6 and the inner boots 7, including the leg, changes to one shown by the one-dot chain line in FIG. 1. Thus, it is possible to increase the angle of forward inclination of the leg. On the other hand, when the upper portion of the shell body 1 is tightened by the band 8 in which the overlap length L is made smaller than the above, the forwardly leaning posture of the above boot portion, including the leg, changes to one shown by the two-dot chain line in FIG. 1. Thus, the angle of forward inclination of the leg can be adjusted such as to be larger than that in the case shown by the one-dot chain line.

The adjustment of the forward inclination pressure will next be described.

In this case, with the buckle 9 opened, the screw member 21 of the forward inclination pressure adjusting mechanism 12 is rotated using the crown 21*a* so that the movable member 22 is slid in the direction of the arrow A in FIG. 7 until the band 8 is moved to the position shown by either the one-dot chain line or the two-dot chain line in FIG. 1, and the band 8 is tightened. In consequence, the distance between the heel which serves as a fulcrum when the leg leans forward and the ankle which serves as a point of action at that time is shortened, and the degree to which the heel is released from the pressure applied thereto by the upper portion of the shell body 1 is increased correspondingly, so that the pressure which the skier feels when he leans forward is reduced. In other words, it is possible to adjust the forward inclination pressure by vertically varying the position of the band 8 at which it tightens the upper portion of the shell body 1.

It is to be noted that the structure of the forward inclination angle adjusting mechanism 11 in the present invention is not necessarily limited to the type shown in the above embodiment, and it is possible to employ any type of adjusting mechanism, provided that the mechanism employed can adjust the length of the portion of the band 8 on the front cuff side which is restrained by the outer and inner upper shells 4*a*, 4*b* of the shell body 1. The connecting projections 15*a*, 15*b* may be formed integral with the overlap portion 8*a* of the band 8, or may be constituted by a U-shaped separate member. Similarly, the forward inclination pressure adjusting mechanism 12 is, as a matter of course, not necessarily limited to that exemplified in the above embodiment. For example, the mechanism 12 may have the structure in which the screw member 21 is assembled together with the upper shell 4*a* in one unit, or the structure in which the movable member 22 is separable from the band 8.

As described above, in accordance with this embodiment, a band with a buckle for tightening the outer periphery of the upper portion of the shell body corresponding to the ankle portion is provided with a forward inclination angle adjusting mechanism for adjusting the angle of forward inclination of the leg by adjusting the length of the portion of the band on the front side which is restrained from moving circumferentially by means of the outer and inner upper shells of the shell body. It is therefore possible to increase the range within which the forward inclination angle is adjustable, to effect fine adjustment, and to adjust the forward inclination angle so as to be adapted for the leg of each individual skier Further, the upper portion of the shell body is provided with a forward inclination pressure adjusting mechanism for adjusting the pressure applied to the leg from the boot upper when the skier leans forward, by vertically adjusting the position of the upper portion of the shell body at which it is tightened by the band by means of a screw member. It is therefore possible to effect fine adjustment of the forward inclination pressure and obtain an optimum forward inclination pressure suitable for each individual skier. In addition, it is possible for a skier inexperienced in these operations to use the ski boot easily and without anxiety.

The following is a description of a second embodiment of the ski boot according to the present invention which is provided with a fastening mechanism having functions of adjusting the angle of forward inclination of the leg and the pressure applied to the leg from the boot upper when the skier leans forward, with reference to FIGS. 8 to 14.

In these Figures, the reference numeral 31 denotes a shell body molded from a rigid plastic material such as a polyurethane. The shell body 31 is constituted by a sole 32, a lower shell 33 covering the foot, and outer and inner upper shells 34*a*, 34*b* which respectively cover the right- and left-hand sides of the ankle. The upper shells 34*a*, 34*b* are so shaped that they cover the right- and left-hand sides of the ankle, respectively. In consequence, the front and rear of the shell body 31 are opened, and the shells 34*a*, 34*b* are tilted forwards. In addition, the openings at the front and rear of the shell body 31 are respectively closed by a front cuff 35 and a rear cuff 36 from the inner side of the upper shells 34*a*, 34*b*. The respective lower ends of the front and rear cuffs 35 and 36 are pivotally connected to the lower shell 33 so that the cuffs 35 and 36 can tilt forwards and backwards. Thus, when the foot is inserted into the ski boot, both the cuffs 35, 36 are tilted so as to be expanded outwards as shown by the two-dot chain line in FIG. 11.

Figure 10:
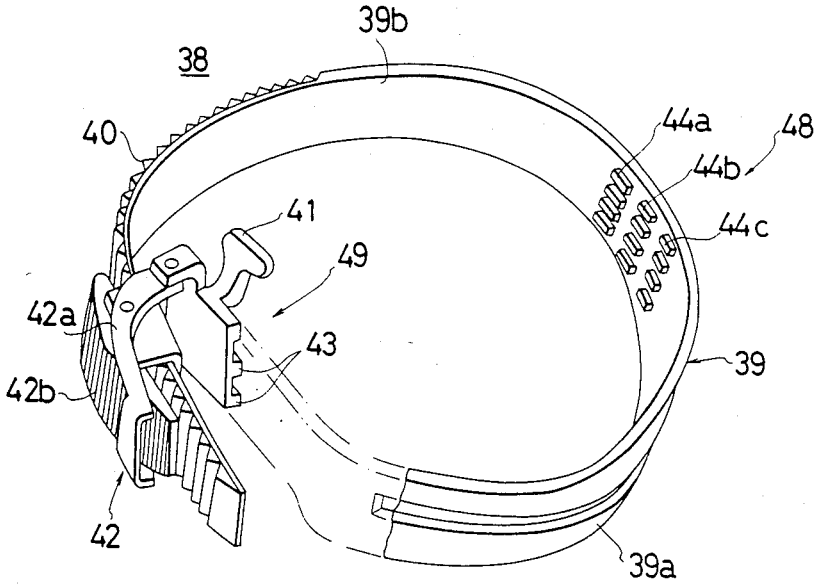
FIG. 10 is a perspective view of the whole arrangement of the fastening mechanism according to the present invention.

The reference numeral 37 denotes inner boots molded from a flexible material and interposed between the shell body 31 and the foot of the skier for the purporse of stably and yet comfortably fitting the foot into the sheel body 31. The numeral 38 denotes a fastening mechanism which has a belt-shaped band 39 made of a plastic material, as shown in FIG. 10. A saw-tooth portion 40 is formed on the outer surface of one end of the band 39 over a desired length. An engagement portion 41 for connecting the band 39 to the outer upper shell 34*a* is integrally formed at the other end of the band 39 so as to project inwardly. Further, a buckle 42 is integrally connected to the second end of the band 39 for the purpose of tightening the upper shell portion while holding the end portion of the band 39 on the side of the saw-tooth portion 40. The buckle 42 is constituted by a frame member 42*a* pivotally connected to one end of the band 39, and a pawl member 42*b* which is pivotally attached to the frame member 42*a* and which engages with the saw-tooth portion 40. The fastening mechanism 38 has a forward inclination angle adjusting mechanism for adjusting the angle of forward inclination of the leg (the angle of forward inclination of the upper of the ski boot with respect to the plane of the sole) by adjusting the length of the portion of the band 39 on the front cuff side which is restrained from moving circumferentially by the outer and inner upper shells 34*a*, 34*b*, and a forward inclination pressure adjusting mechanism 49 for adjusting the pressure applied to the leg from the boot upper when the skier leans forward by vertically adjusting the position of the upper portion of the shell body 31 at which it is tightened by the band 39. Further, retaining portions 43 in the shape of projections for positioning the band 39 with respect to the outer upper shell 34*a* are formed in the inner surface of the second end of the band 39. A plurality of rows, that is, three rows, of retaining portions 44*a*, 44*b*, 44*c* in the shape of projections are longitudinally formed on the inner surface of the intermediate portion of the band 39 for the purpose of setting the angle of forward inclination of the leg with respect to the plane of the sole 32 of the shell body 31, the retaining portions 44*a* to 44*c* being engageable with the inner upper shells 34*b*.

Figure 8:
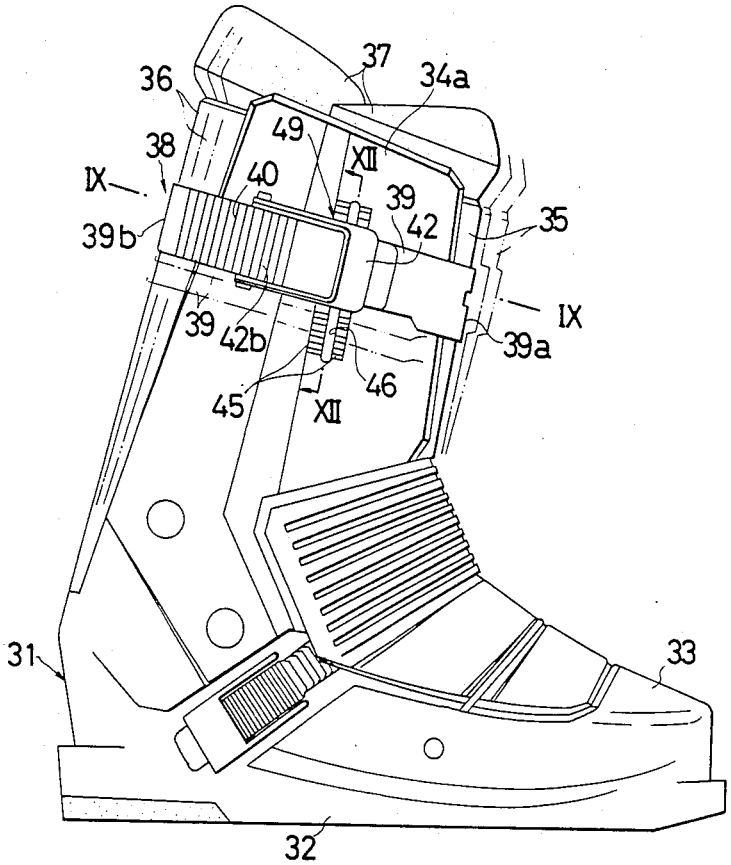
FIG. 8 is a side view of a ski boot equipped with a fastening mechanism in accordance with a second embodiment of the present invention.
Figure 9:
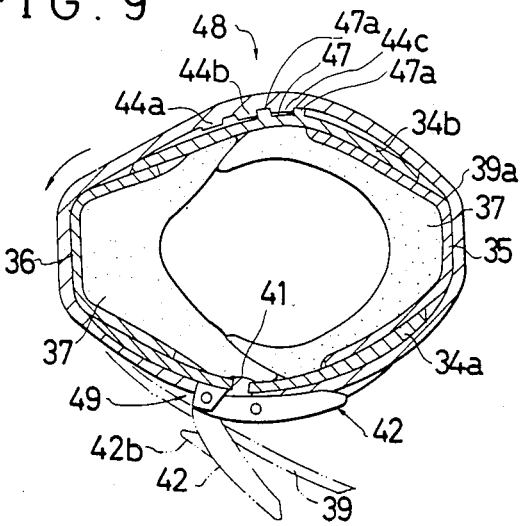
FIG. 9 is a sectional view taken along the line IX—IX of FIG. 8.
Figure 11:
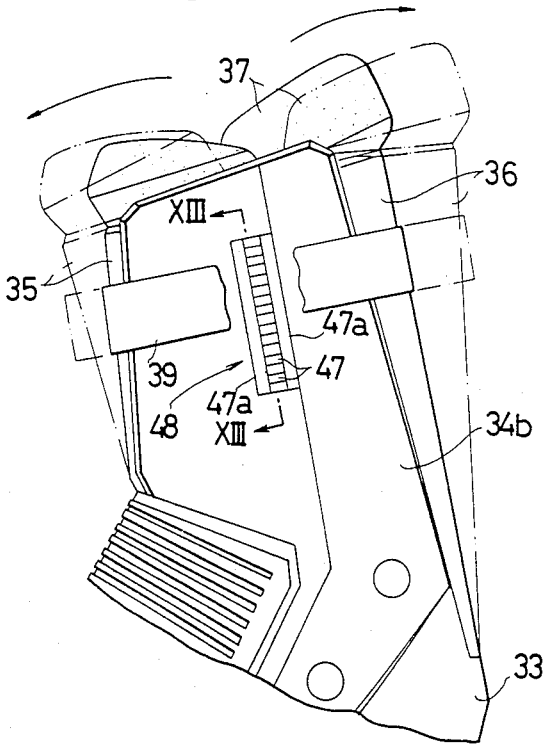
FIG. 11 is a side view of the ski boot according to the present invention as viewed from the inside thereof.
Figure 12:
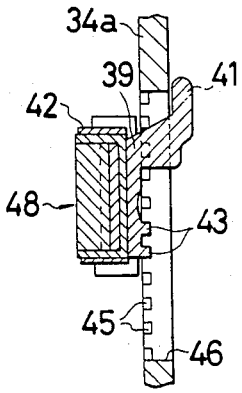
FIG. 12 is a sectional view taken along the line XII—XII of FIG. 8.
Figure 13:
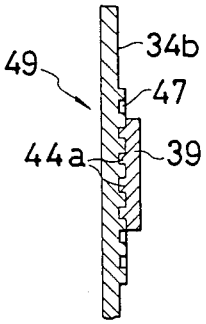
FIG. 13 is a sectional view taken along the line XIII—XIII of FIG. 11.

The outer upper shell 34*a* is, as shown in FIGS. 8 and 12, formed with a multiplicity of positioning engagement portions 45 in the shape of recesses for setting a forward inclination pressure, which engage with the retaining portions 43 of the band 39, the engagement portions 45 being arranged at predetermined regular spacings in the longitudinal direction of the upper shell 34*a*. Further, a slot 46 is formed in the outer upper shell 34*a* over the entire length of the row of the engagement portions 45 and at the center of the lateral width of the engagement portions 45. The engagement projection 41 of the band 39 is slidably engaged with the slot 46. Similarly, the inner upper shell 34*b* is, as shown in FIGS. 11 and 13, formed on its outer surface with a multiplicity of positioning engagement portions 47 in the shape of recesses for setting a forward inclination pressure so that they oppose the engagement portions 45 of the outer upper shell 34*a*, the engagement portions 47 being arranged at predetermined regular spacings in the longitudinal direction of the upper shell 34*b*. Thus, the position of the band 39 which is adjusted vertically is reliably maintained at a set level. Further, engagement projections 47*a* are respectively formed on both sides of the engagement portions 47 so as to extend longitudinally of the upper shell 34*b*. One of the forward inclination angle setting retaining portions 44*a* to 44*c* of the band 39 is engaged with either one of the engagement projections 47*a*.

In this embodiment, the forward inclination angle adjusting mechanism 48 is constituted by the forward inclination angle setting retaining portions 44*a*, 44*b*, 44*c* provided on the inner surface of the intermediate portion of the band 39, and the forward inclination angle setting engagement portions 47 provided on the inner upper shell 34*b*. On the other hand, the forward inclination pressure adjusting mechanism 49 is constituted by the retaining portions 43 for positioning the band 39 with respect to the outer upper shell 34*a*, and the positioning engagement portions 45 for setting the forward inclination pressure which engage with the retaining portions 43.

The operation of this embodiment arranged as detailed above will be described below.

To wear the ski boot in a state wherein the foot of the skier appropriately fits with the boot, first, the engagement projection 41 of the band 39 is inserted into the slot 46 of the outer upper shell 34*a* so as to engage therewith, and the foot is inserted into the space defined by the inner boots 37. Then, the band 39 is wound around the respective outer peripheries of the upper shells 34*a*, 34*b* and the cuffs 35, 36, and the projections 43 provided on one end of the band 39 are engaged with the positioning recesses 45 at a position selected in terms of the vertical direction. Further, one of the retaining portions 44*a* to 44*c* on other side of the band 39 is engaged with a part of the positioning engagement portions 47 at the same level as the projections 43 at the first end of the band 39. In this state, the free end of the band 39 is inserted into the buckle 42, and the pawl member 42*b* is engaged with the saw-tooth portion 40 of the band 39. Then, the buckle frame member 42*a* is pivoted in the tightening direction. Thereupon, the tightening force of the band 39 causes the whole of the upper shells 34*a*, 34*b*, including the cuffs 35, 36, to be tightened. At this time, the band portion 39*a* located between the retaining portions 43 and 44*c* and on the front cuff side is restrained by means of the engagement portions 45 and 47. Therefore, said band portion is hardly moved in the direction of the arrow shown in FIG. 9 even when the tightening force is applied to the band 39. However, the band portion 39*b* on its free end side, that is, the rear cuff side, which is retained by the buckle 42 is moved in the direction of the arrow in FIG. 9 by the tightening force. In consequence, the portion of the band 39 on the rear cuff side is tightened inwardly, thus causing the whole of the inner boots 37, including the rear cuff 36, to be pushed toward the front cuff 35 with respect to the shells 34*a*, 34*b*. Accordingly, the leg is forcedly inclined forward with respect to the plane of the sole 32 of the shell body 31. The forward inclination pressure at this time is set by vertically adjusting the position of the band 39 using the forward inclination pressure adjusting mechanism 49.

When the angle of forward inclination of the inner boots 37 and the front and rear cuffs 35, 36, including the leg, is desired to be made larger than that in the state shown by the solid line in FIG. 8, the retaining portion 44*b* is engaged with the positioning engagement portions 47, and the band 39 is tightened, whereby the forwardly inclined posture of the front and rear cuffs 35, 36 and the inner boots 37, including the leg, changes to one shown by the one-dot chain line in FIG. 8. Thus, it is possible to increase the angle of forward inclination of the leg. On the other hand, when the retaining portion 44*a* is engaged with the positioning engagement portions 47 and the band 39 is tightened, the forwardly inclined posture of the boot portion, including the leg, changes to one shown by the two-dot chain line in FIG. 8, whereby the forward inclination angle can be adjusted such as to be larger than that in the case shown by the one-dot chain line.

The adjustment of the forward inclination pressure will next be described.

Figure 14:
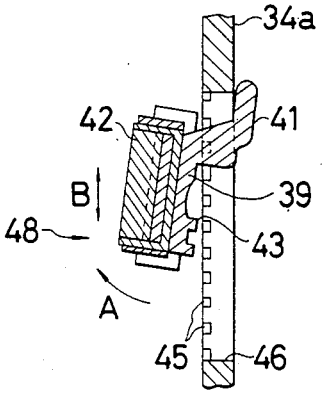
FIG. 14 is a sectional view, corresponding to FIG. 13, which shows the way in which the position of the band according to the present invention is set.

In this case, first, the band 39 is untightened, and the retaining portion 44*c* is disengaged from the engagement portions 47. Then, the end portion of the band 39 provided with the buckle 42 is pivoted in the direction of the arrow A about the engagement projection 41 so that the retaining portions 43 are disengaged from the engagement portions 45, as shown in FIG. 14. In this state, the engagement projection 41 is slid along the slot 46 in the direction of the arrow B, thereby changing the position of engagement between the retaining portions 43 of the band 39 and the positioning engagement portions 45 and the position of engagement between the retaining portion 44*c* (or the retaining portion 44*a* or 44*b*) of the band 39 and the positioning engagement portions 47. For example, when the position of the band 39 at which it tightens the upper shells 34*a*, 34*b* is moved to that shown by either the one-dot chain line or the two-dot chain line in FIG. 8, the distance between the heel which serves as a fulcrum when the skier leans forward and the ankle which serves as a point of action at that time is shortened, and the degree to which the heel is released from the pressure applied thereto by the upper portion of the shell body 31 is increased correspondingly, so that the pressure which the skier feels when he leans forward is reduced. In other words, it is possible to adjust the forward inclination pressure by vertically varying the position of the band 39 at which it tightens the upper portion of the shell body 31.

As described above, in accordnce with this embodiment, a plurality of positioning engagement portions for setting a forward inclination pressure are vertically formed on each of the respective outer surfaces of the outer and inner upper shells of a shell body, and a retaining portion which engages with the positioning engagement portions of the outer upper shell is provided at one end of a band for tightening the upper shells Further, a plurality of retaining portions which engage with the positioning engagement portions of the inner upper shell are provided on the intermediate portion of the band in the longitudinal direction thereof. By virtue of this arrangement, it is only necessary for the skier to wind the band around the respective outer peripheries of the shells, set each of the engagement portions at a desired position on the corresponding positioning engagement portions, retain the free end portion of the band by a buckle attached to one end of the band, and tighten the band. Accordingly, tightening of the upper of the ski boot and adjustment of the forward inclination angle and the forward inclination pressure can be effected in a single and simple operation. In addition, it is possible for even a skier inexperienced in such operation to use the ski boot readily and without anxiety.

Figure 15:
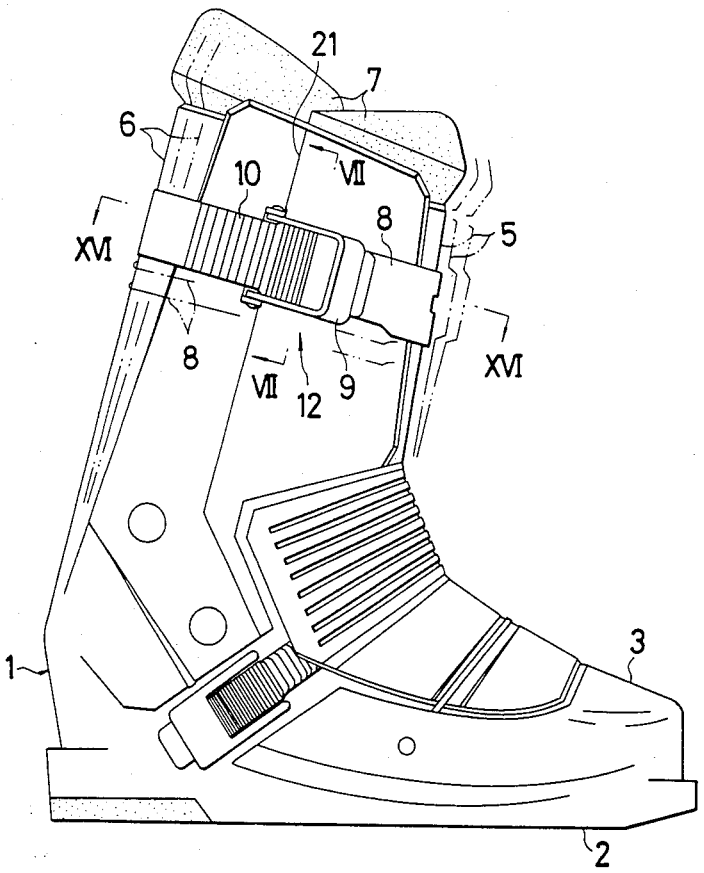
FIG. 15 is a side view of a third embodiment of the ski boot according to the present invention.
Figure 16:
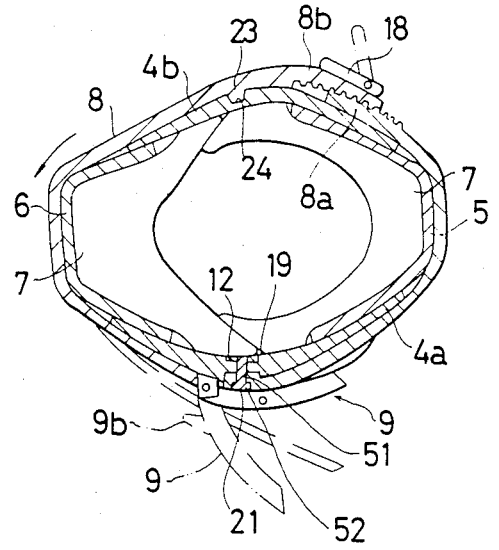
FIG. 16 is a sectional view taken along the line XVI—XVI of FIG. 15.
Figure 17:
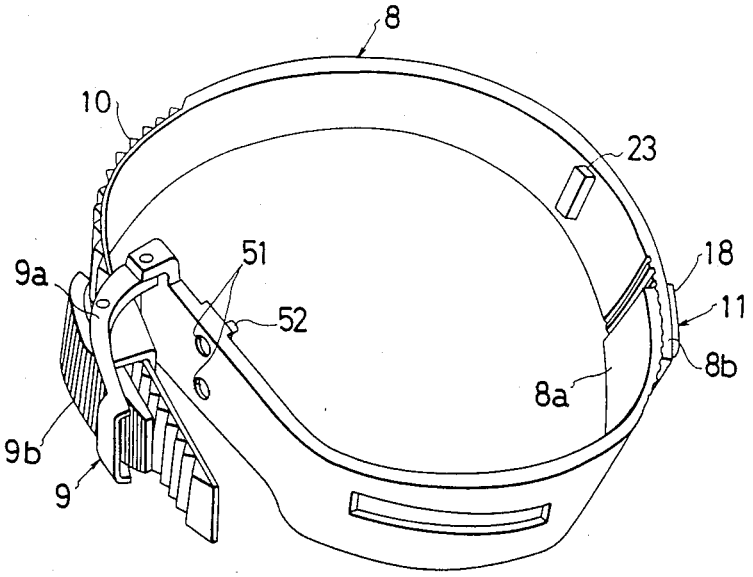
FIG. 17 is a perspective view of the whole arrangement of the band with a forward inclination angle adjusting mechanism in accordance with the third embodiment of the present invention.
Figure 18:
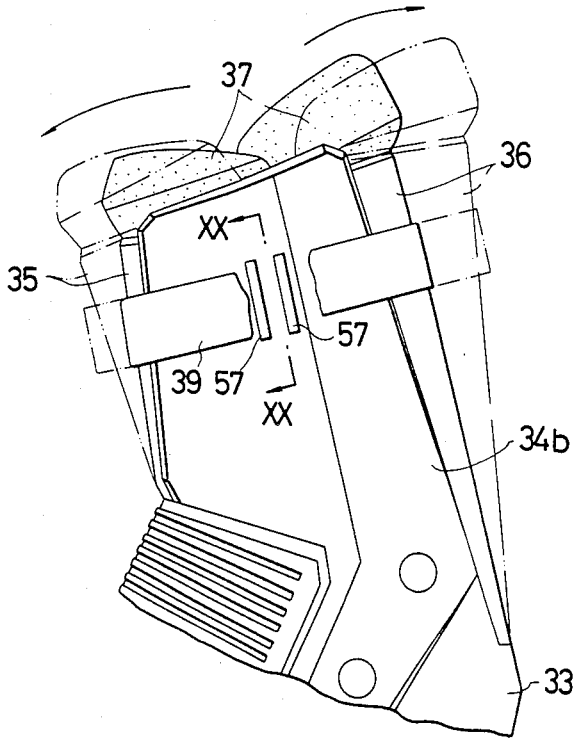
FIG. 18 is a fragmentary enlarged side view of a fourth embodiment of the ski boot according to the present invention, which shows the movement of the ski boot in response to the forward inclination angle adjustment.

FIGS. 15 to 17 show in combination a third embodiment of the ski boot according to the present invention. More specifically, this embodiment is arranged such that the forward inclination pressure adjusting mechanism 12 is removed from the ski boot arranged in accordance with the first embodiment described with reference to FIGS. 1 to 7, with the forward inclination angle adjusting mechanism 11 left as it is, and the band 8 is provided with bores 51 through which the band 8 is secured to the shell body 1 by means of fixing members 52 such as rivets.

Accordingly, as shown in FIG. 15, the ski boot in accordance with this embodiment may be recognized to be one in which the forward inclination pressure adjusting mechanism 12 is removed from the ski boot shown in FIG. 1, and the details of this ski boot are such as those shown in FIGS. 16 and 17. It is to be noted that since the details of each portion of this embodiment are the same as those in the first embodiment except for the forward inclination pressure adjusting mechanism 12, which is removed in this embodiment, the same portions as those in the first embodiment are denoted by the same reference numerals, and description thereof is omitted.

The ski boot in accordance with this embodiment, thus arranged, can offer advantageous effects similar to those offered by the forward inclination angle adjusting mechanism 11 in the first embodiment.

Figure 19:
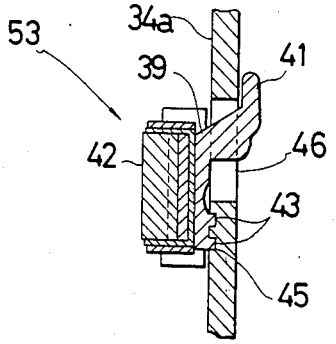
FIG. 19 is a sectional view of the band retaining portion of the fourth embodiment.
Figure 20:
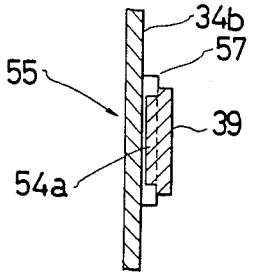
FIG. 20 is a sectional view of the forward inclination angle adjusting mechanism in its engaged state.
Figure 21:
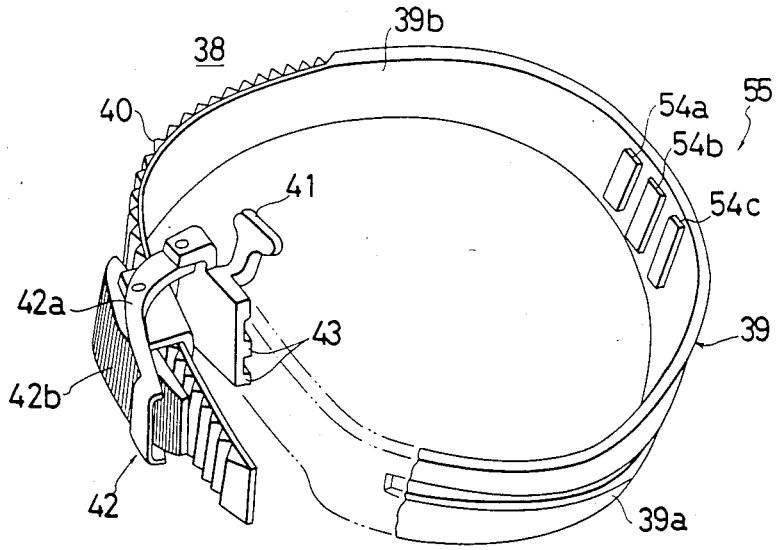
FIG. 21 is a perspective view of the whole arrangement of the band with the forward inclination angle adjusting mechanism in accordance with the fourth embodiment of the present invention.

FIGS. 18 to 21 show in combination a fourth embodiment of the ski boot according to the present invention. More specifically, the forward inclination pressure adjusting mechanism 49 of the ski boot in accordance with the second embodiment described with reference to FIGS. 8 to 14, which is constituted by the retaining portions 41, 43, the positioning engagement portions 45 for setting a forward inclination pressure and the slot 46, is modified so as to serve only as a band engaging and disengaging means 53 which has the function that the engagement portion 41 is fitted into the slot 46 and the function that the retaining portions 43 are respectively engaged with the engagement portions 45, as shown in FIG. 19. Moreover, the forward inclination angle adjusting mechanism 48, which is constituted by the retaining portions 44*a* to 44*c* and the positioning engagement portions 47, is changed to a forward inclination angle adjusting mechanism 55 which is constituted by three ridges 54*a*, 54*b*, 54*c* provided on the band 39 and two positioning engagement portions 57 provided on the inner upper shell 34*b*.

It is possible for the forward inclination angle adjusting mechanism 55 in accordance with this embodiment to function in a manner similar to that of the mechanism 48 in accordance with the second embodiment.

Figure 22:
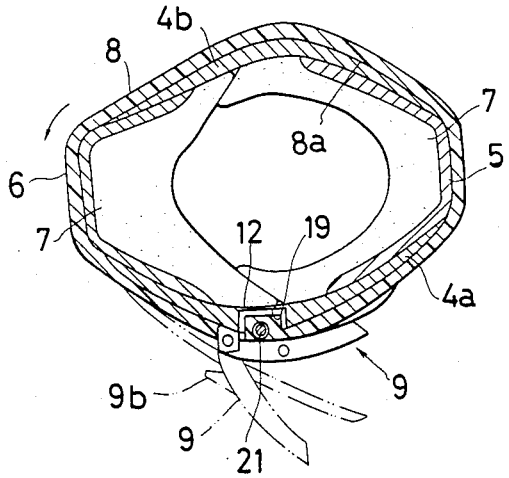
FIG. 22 is a sectional view of an essential portion of a fifth embodiment of the ski boot according to the present invention.
Figure 23:
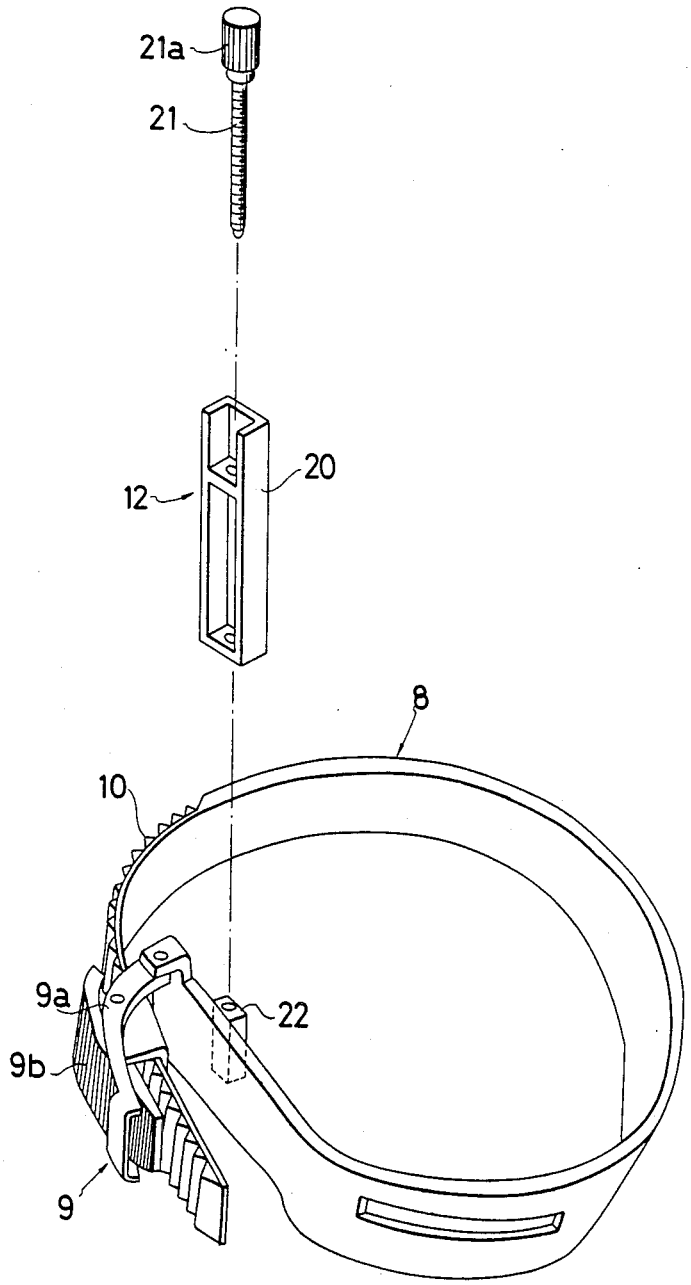
FIG. 23 is a perspective view of the whole arrangement of the band with a forward inclination pressure adjutsing mechanism in accordance with the fifth embodiment of the present invention.

FIGS. 22 and 23 show in combination a fifth embodiment of the ski boot according to the present ivnention. More specifically, in this embodiment the forward inclination angle adjusting mechanism 11 is removed from the ski boot in accordance with the first embodiment described with reference to FIGS. 1 to 7, with the forward inclination pressure adjusting mechanism 12 left alone.

According to this embodiment, therefore, FIG. 1 which shows the forward inclination pressure adjusting mechanism 12 may be recognized as a side view of the ski boot in accordance with this embodiment, and FIG. 7 which shows the mechanism 12 in detail may similarly be recognized as an enlarged sectional view of the mechanism 12.

Since this embodiment is recognized as one in which the forward inclination angle adjusting mechanism 11 is removed from the first embodiment, the details of each portion are the same as those in the first embodiment. Therefore, the same portions as those in the first embodiment are denoted by the same reference numerals, and description thereof is omitted.

The ski boot in accordance with this embodiment, thus arranged, can offer advantageous effects similar to those offered by the forward inclination pressure adjusting mechanism 12 in the first embodiment.

Figure 24:
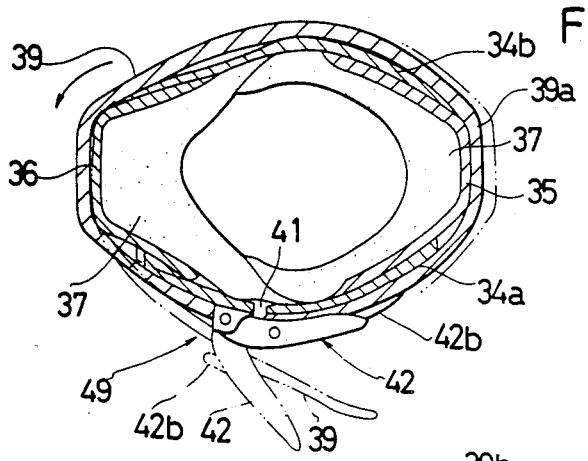
FIG. 24 is a sectional view of an essential portion of a sixth embodiment of the ski boot according to the present invention.
Figure 25:
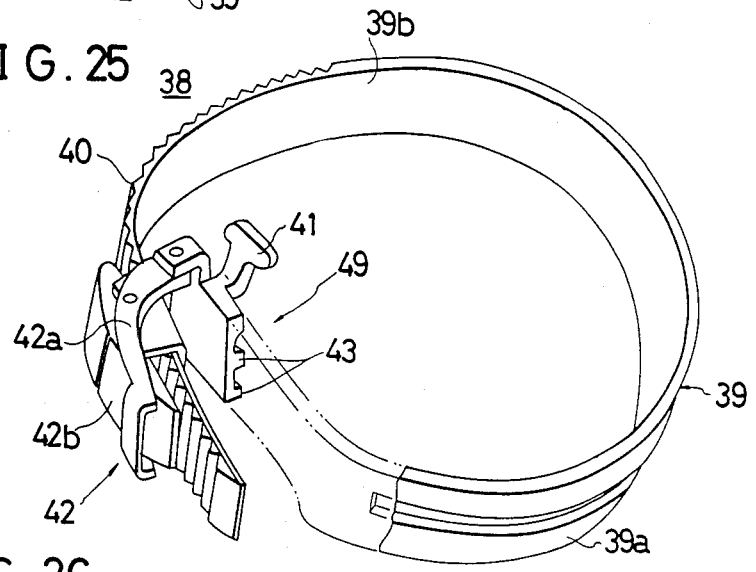
FIG. 25 is a perspective view of the whole arrangement of the band with a forward inclination pressure adjusting mechanism in accordance with the sixth embodiment of the present invention.

FIGS. 24 and 25 show in combination a sixth embodiment of the ski boot according to the present invention. More specifically, in this embodiment the forward inclination angle adjusting mechanism 48 constituted by the retaining portions 44*a* to 44*c* and the positioning engagement portions 47 is removed from the ski boot in accordance with the second embodiment described with reference to FIGS. 8 to 14, with the forward inclination pressure adjusting mechanism 49 left alone, which is constituted by the retaining portions 41, 43, the positioning engagement portions 45 for setting a forward inclination pressure and the slot 46.

According to this embodiment, therefore, FIG. 8 which shows the forward inclination pressure adjusting mechanism 49 may be recognized as a side view of the ski boot in accordance with this embodiment, and FIGS. 12 and 14 which show the mechanism 49 in detail may similarly be recognized as enlarged sectional views.

Since this embodiment is recognized as one in which the forward inclination angle adjusting mechanism 48 is removed from the first embodiment, the details of each portion are the same as those in the second embodiment. Therefore, the same portions as those in the second embodiment are denoted by the same reference numerals, and description thereof is omitted.

The ski boot in accordance with this embodiment, thus arranged, can offer advantageous effects similar to those offered by the forward inclination pressure adjusting mechanism 49 in accordance with the second embodiment.

Figure 26:
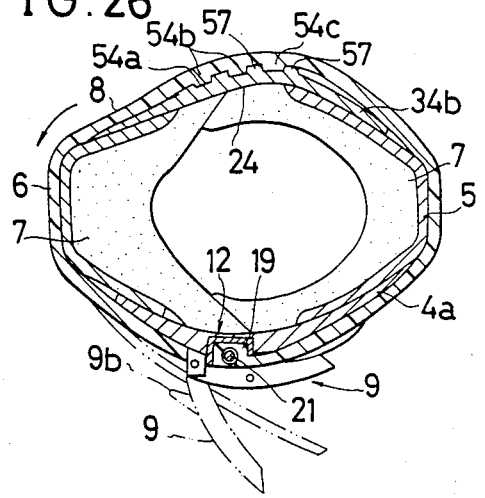
FIG. 26 is a sectional view of an essential portion of a seventh embodiment of the ski boot according to the present invention.
Figure 27:
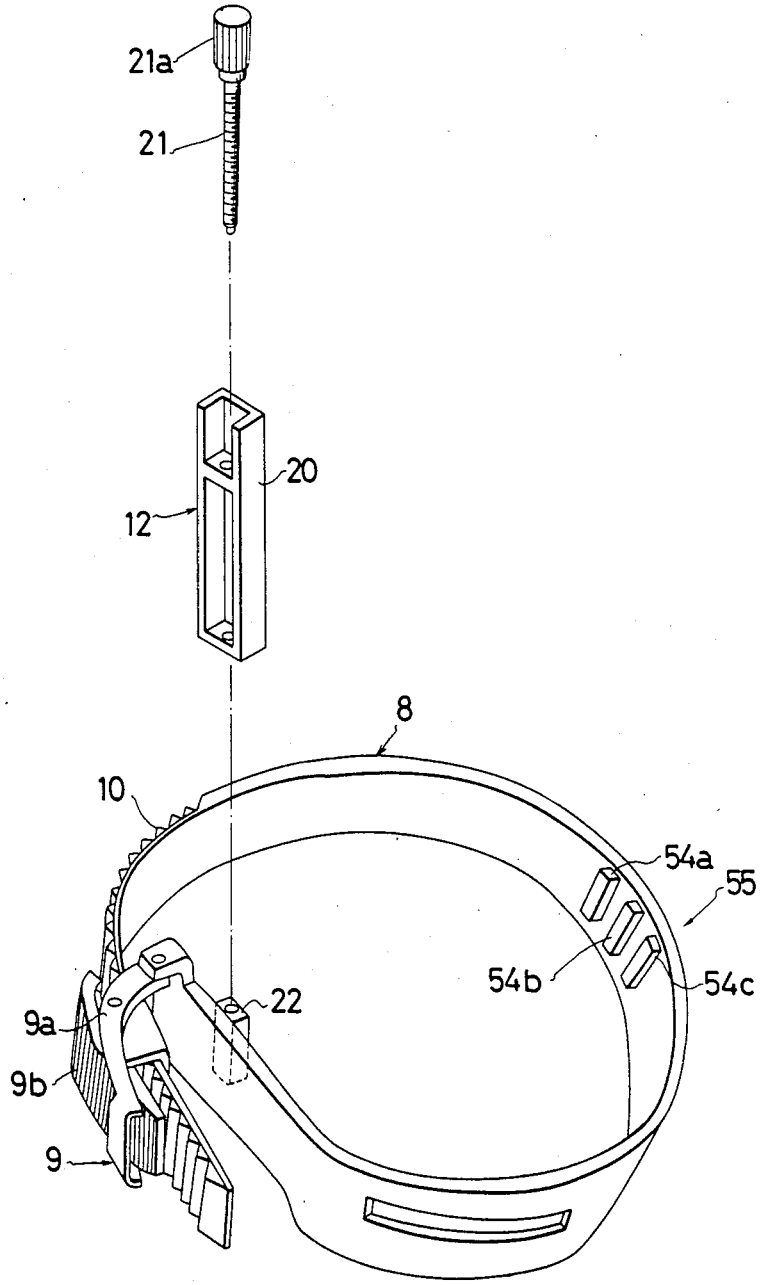
FIG. 27 is a perspective view of the whole arrangement of the band with a forward inclination angle adjusting mechanism and a forward inclination pressure adjusting mechanism in accordance with the seventh embodiment of the present invention.

FIGS. 26 and 27 show in combination a seventh embodiment of the ski boot according to the present invention. More specifically, in this embodiment the forward inclination angle adjusting mechanism 11 of the ski boot in accordance with the first embodiment described with referecne to FIGS. 1 to 7 is replaced by the forward inclination angle adjusting mechanism 55 of the ski boot in accordance with the fourth embodiment described with reference to FIGS. 18 to 21.

Accordingly, in this embodiment, the forward inclination pressure adjusting mechanism 12 in accordance with the first embodiment which utilizes the movement of a screw is combined with the forward inclination angle adjusting mechanism 55 in accordance with the fourth embodiment which utilizes positioning ridges provided on the band 8. It is therefore possible to incorporate both the forward inclination angle adjusting mechanism 11 (48) and the forward inclination pressure adjusting mechanism 12 (49) in the ski boot similarly to the first and second embodiments. Thus, it is possible for this embodiment to offer advantageous effects similar to those offered by the first and second embodiments.

Figure 28:
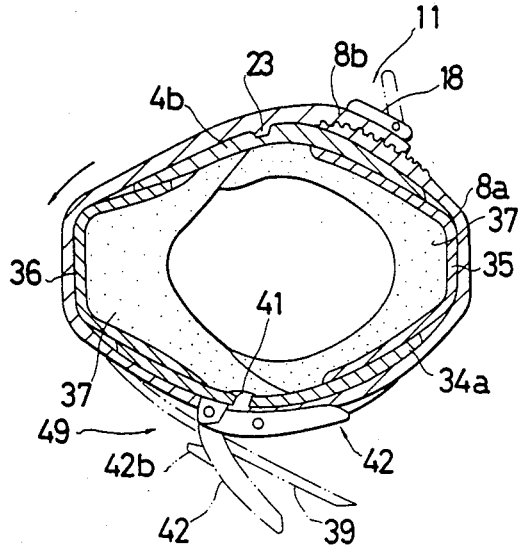
FIG. 28 is a sectional view of an essential portion of an eighth embodiment of the ski boot according to the present invention.
Figure 29:
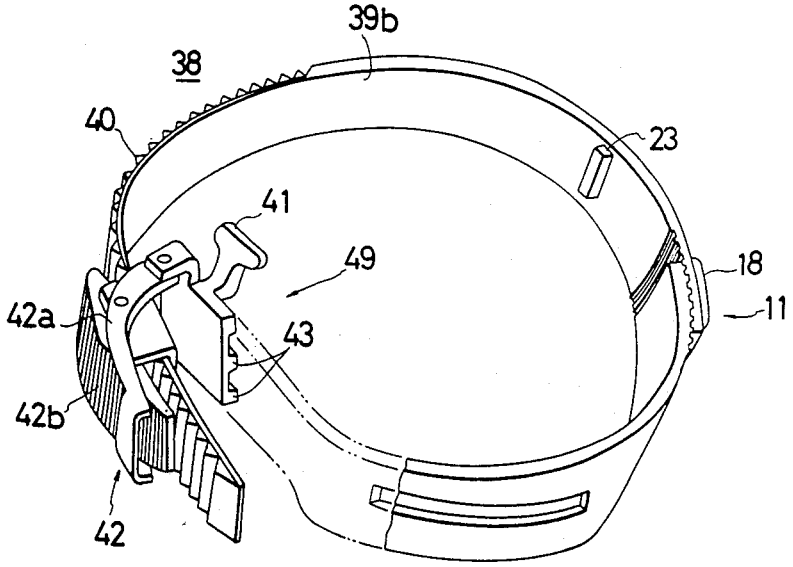
FIG. 29 is a perspective view of the band with a forward inclination angle adjusting mechanism and a forward inclination pressure adjusting mechanism in accordance with the eighth embodiment according to the present invention.

FIGS. 28 and 29 show in combination an eighth embodiment of the ski boot according to the present invention. In this embodiment, the forward inclination angle adjusting mechanism 48 of the ski boot in accordance with the second embodiment described with reference to FIGS. 8 to 14 is replaced by the forward inclination angle adjusting mechanism 11 in accordance with the first embodiment, with the forward inclination pressure adjusting mechanism 49 in accorance with the second embodiment left alone.

In the case of this embodiment also, it is possible to incorporate both the forward inclination angle adjusting mechanism and the forward inclination pressure adjusting mechanism in the ski boot similarly to the first, second and seventh embodiments, and it is therefore possible for the eighth embodiment to offer advantageous effects similar to those offered by these embodiments.

What is claimed is:

1. A ski boot comprising:

a shell body having a lower shell and upper outer and inner shells provided on opposite sides of said lower shell;

said upper outer and inner shells being spaced apart in their forward and rearward portions to define front and rear openings;

tiltably mounted from and rear cuffs respectively covering said front and rear openings;

a band wound around the respective outer peripheries of said upper outer and inner shells and said cuffs;

means connecting the end portions of said band in a manner to thereby apply a tightening force to said band;

a forward inclination angle adjusting mechanism provided on said band for adjusting the angle of forward inclination of the skier's leg, including adjusting means for adjusting the length of the portion of said band extending across the front cuff, thereby being restrained from moving circumferentially with relation to said upper outer and inner shells;

a forward inclination pressure adjusting mechanism mounted on the upper outer surface of said shell body for adjusting the pressure applied to the skier's leg by said boot when the skier leans forwardly including means for vertically adjusting the position of said band through which it tightens said boot; said pressure adjusting mechanism comprising a screw member axially perpendicular to the band, said screw member being mounted upon the proximate portion of the upper shell and engaged with an internally threaded boss provided on said band.

2. A ski boot according to claim 1 wherein the means connecting the end portions of said band for tightening thereof comprises a buckle.

3. A ski boot in accordance with claim 1 wherein an inner boot is disposed within the shell body.

4. A ski boot comprising:

a shell body having a lower shell and outer and inner upper shells provided on opposite sides of said lower shell;

said upper outer and inner shells being spaced apart in their forward and rearward portions to define front and rear openings;

tiltably mounted front and rear cuffs respectively covering said front and rear openings;

a band wound around the respective outer peripheries of said outer and inner upper shells and said cuffs;

means connecting the end portions of said band in a manner to thereby apply a tightening force to said band;

a forward inclination pressure adjusting mechanism mounted on the upper outer surface of said shell body for adjusting the pressure applied to the skier's leg by said boot when the skier leans forwardly including means for vertically adjusting the position of said band through which it tightens said boot, said pressure adjusting mechanism comprising a screw member axially perpendicular to the band, said screw member being mounted upon the proximate portion of the upper shell and engaged with an internally threaded boss provided on said band.

5. A ski boot according to claim 4 wherein the means connecting the end portions of said band for tightening thereof comprises a buckle.

6. A ski boot according to claim 4 wherein an inner boot is disposed within the shell body.

7. A ski boot comprising:

a shell body having a lower shell and outer and inner upper shells provided above, and integral with, said lower shell on the right- and left-hand sides thereof, respectively;

an inner boot inserted into said shell body;

tiltable front and rear cuffs respectively covering front and rear openings defined between said outer and inner upper shells;

a forward inclination pressure adjusting mechanism for adjusting the pressure applied to the skier's leg by said boot when the skier leans forward including a plurality of positioning engagement portions being formed, and arranged vertically, on the respective outer surfaces of said upper outer and inner shells, a band having opposite ends wound about the respective outer peripheries of said upper shells and said cuffs, one end of said band being vertically movably connected to one of said upper outer shells, a first retaining portion provided on the inwardly directed surface of said one end of said band and being adapted for engagement with one of said positioning engagement portions formed on said upper, outer shell;

a forward inclination angle adjusting mechanism for adjusting the angle of forward inclination of the skier's leg including a plurality of second retaining portions provided on the inner surface of the intermediate portion of said band;

said second retaining portions being arranged longitudinally of said band;

said second retaining portions being engageable with one of said positioning engagement portions; and, means for tightening said band at one end thereof and effecting retention of the other or free end of said band.

8. A ski boot comprising:

a shell body having a lower shell and outer and inner upper shells provided on opposite sides of said lower shell;

said upper outer and inner shells being spaced apart in their forward and rearward portions to define front and rear openings;

tiltably mounted front and rear cuffs respectively covering said front and rear openings;

first and second positioning engagement portions formed respectively on the outer surfaces of said upper outer and inner shells;

a band having opposite ends wound about the respective outer periphery of said upper shells and said cuffs;

a first retaining portion formed on the inner surface of one end of said band and engageable with the positioning engagement portion formed around the proximate outer upper shell;

a forward inclination angle adjusting mechanism for adjusting the forward inclination of the skier's leg, including a plurality of second retaining portions formed on the inner surface of the intermediate portion of said band and being arranged longitudinally of said band, said second retaining portions being engageable with the other positioning engagement portion formed on said upper inner shell; and, means connected to one end of said band for effecting tightening thereof and for retention of the other or free end of said band.

9. A ski boot comprising:

a shell body having a lower shell and outer and inner upper shells provided above, and integral with, said lower shell on the right- and left-hand sides thereof, respectively;

an inner boot inserted into said shell body;

tiltable front and rear cuffs respectively covering front and rear openings defined between said outer and inner upper shells;

a forward inclination pressure adjusting mechanism for adjusting the pressure applied to the skier's leg by said boot when the skier leans forwardly including a plurality of positioning engagement portions formed on the outer surface of at least one of said upper outer and inner shells and with said engagement portions being arranged vertically;

a band wound about the outer peripheries of said upper shells and said cuffs;

a retaining portion formed on the inner surface of one end of said band and being positioned thereon to effect engagement with one of said positioning engagement portions formed on said upper shell; and, means connected to one end of said band for effecting tightening thereof and for retention of the free end of said band.

10. A ski boot comprising:

a shell body having a lower shell and outer and inner upper shells provided above, and integral with, said lower shell on the right- and left-hand sides thereof, respectively;

an inner boot inserted into said shell body;

tiltable front and rear cuffs respectively covering front and rear openings defined between said outer and inner upper shells;

a band having opposite ends wound about the respective outer peripheries of said upper shells and said cuffs;

a forward inclination angle adjusting mechanism for adjusting the angle of forward inclination of the skier's leg including retaining portions provided spacedly and arranged longitudinally on the inner surface of the intermediate portion of said band, a plurality of positioning engagement portions provided on the upper outer surface of one of said upper outer and inner shells;

means for tightening said band at one end thereof and effecting retention of the other or free end of said band;

a forward inclination pressure adjusting mechanism mounted on the upper outer surface of said shell body for adjusting the pressure applied to the skier's leg by said boot when the skier leans forwardly including a screw member axially perpendicular to the band and being mounted upon the proximate portion of the upper shell and engageable with an internally threaded boss provided on said band.

* * * * *